United States Patent [19]

Grim et al.

[11] Patent Number: 4,937,456

[45] Date of Patent: Jun. 26, 1990

[54] DIELECTRIC COATED ION THRUSTER

[75] Inventors: Donald Grim, Renton; Paul G. Lichon, Bothell, both of Wash.

[73] Assignee: The Boeing Company, Seattle, Wash.

[21] Appl. No.: 258,618

[22] Filed: Oct. 17, 1988

[51] Int. Cl.[5] ..... H01J 33/00

[52] U.S. Cl. ..... 250/427; 250/423 R; 313/359.1; 313/360.1; 313/362.1; 313/363.5; 315/111.31; 315/111.41; 315/111.61; 315/111.81; 60/202; 219/121.48; 219/121.52; 376/144

[58] Field of Search ..... 250/427, 423; 313/359.1, 360.1, 362.1, 363.1; 315/111.31, 111.41, 111.61, 111.81; 60/202; 219/121.48, 121.52; 376/144

[56] References Cited

U.S. PATENT DOCUMENTS

| | | | |
|---|---|---|---|
| 3,603,088 | 9/1971 | Nakanishi | 60/202 |
| 3,620,018 | 11/1971 | Banks | 60/202 |
| 3,744,247 | 7/1973 | Margosian et al. | 313/363.1 |
| 4,447,732 | 5/1984 | Leung et al. | 250/427 |

FOREIGN PATENT DOCUMENTS

| | | | |
|---|---|---|---|
| 2308460 | 11/1976 | France | 250/423 |
| 63-212777 | 9/1988 | Japan | 60/202 |

*Primary Examiner*—Jack I. Berman

*Attorney, Agent, or Firm*—Christensen, O'Connor, Johnson & Kindness

[57] ABSTRACT

An ion thruster for accelerating positively charged ions produced by the collision of free electrons with gas atoms. An ion thruster (10,100) includes a cathode chamber (12, 60, 118) and an ionization chamber (14, 106). The outer surface of an emitter tube (28, 61, 128) is coated with a dielectric material to protect the emitter tube from sputtering erosion. A plurality of bar magnets (20, 22; 108, 110) are arranged in a spaced apart circular array around the cathode chamber with a pole face of each of the magnets tangentially aligned with wall sections (16, 18; 102, 104) of the ionization chamber. The bar magnets thus define a picket fence, wherein the magnetic field between adjacent bar magnets is used to extend the mean path of an electron entering the ionization chamber, improving the probability that it will impact an atom, creating an ion.

A grid plate (112) comprises an accelerator grid (204) coated on its inner and outer surfaces with a dielectric coating (206, 208). The inner dielectric coating assumes the potential of the plasma, functioning as a screen grid, while the outer dielectric coating assumes the generally neutral potential of the plasma beam, functioning as a decelerator grid. The dielectric coatings on the accelerator grid protect it from sputtering erosion, and along with the dielectric coating on the interior surface of the ionization chamber provide thermal insulation, thereby improving the operating efficiency of the ion thruster.

29 Claims, 4 Drawing Sheets

DIELECTRIC COATED ION THRUSTER

TECHNICAL FIELD

The present invention generally relates to an apparatus for generating a plasma, and specifically, to apparatus for accelerating ions extracted from a plasma through a grid to provide thrust.

BACKGROUND OF THE INVENTION

A typical ion thruster includes a thermionic electron emitter or cathode, a power source, a supply of an ionizable gas, a plasma chamber, and an ion-optic grid for electrostatically accelerating ions extracted from the plasma in a beam. A gas such as mercury vapor, argon, or xenon is metered into the plasma chamber at a relatively low pressure. Electrons emitted from the cathode are electrostatically accelerated by an anode disposed in the plasma chamber to a velocity sufficient to produce positive ions as a result of collision of the electrons with atoms of the gas. The ion beam issuing from the plasma chamber through the grid has a relatively high specific thrust that is particularly suitable for propelling a spacecraft or steering a satellite. However, an ion thruster may also be used in a ground-based laboratory vacuum chamber for ion machining, and for ion implantation of semiconductor substrates.

A common problem in conventional ion thrusters is the rapid erosion of the cathode and other internal surfaces caused by the impact of high-energy ions, in a process referred to as "sputtering." Positively charged ions created near the electron emitter are attracted to the negatively charged cathode instead of to the grid. Since the energy of the ions is greater than the sputtering threshold of the cathode material, particles are ejected from the crystal lattice of the cathode. After a relatively short period of operation, the cathode is often so eroded by sputtering that it must be replaced. While replacement of a worn ion thruster cathode in a ground-based laboratory is relatively easy, it is virtually impossible on an unmanned spacecraft; a conventional ion thruster would thus be unsuitable for use on unmanned space missions.

Several prior art patents disclose inventions that are related to the reduction or control of sputtering erosion. For example, in U.S. Pat. No. 3,452,237, a monatomic thick film of gallium is formed over the surface of a hollow tube tantalum cathode by placing the cathode in contact with a small reservoir of gallium arsenide. Apparently, there is a strong bond between the tantalum and gallium atoms that substantially increases the sputtering threshold of the coated cathode, compared to bare tantalum.

In U.S. Pat. No. 3,603,088, a shadow shield is mounted on the extreme outermost end of a hollow tantalum tube comprising the electron emitter (cathode). The shadow shield protects a heater coil surrounding the tube from sputtering damage, as well as preventing the underside coating of an adjacent alumina insulating material by sputtering material. A keeper cap in which is disposed a small aperture, is supported by the alumina insulating material at the end of the tube. The keeper cap is connected to a potential of about 300 volts, so that an arc discharge is initiated between the tantalum tube and the keeper cap, creating a plasma that reduces the negative space charge at the cathode surface. Electrons discharged from the cathode travel through the aperture in the keeper cap into an attached ion chamber.

A dual chamber plasma discharge device is disclosed in U.S. Pat. No. 4,301,391. The first chamber contains an electron emitter and a first anode. An ionizable gas is present in the first chamber at a relatively higher pressure than in the second chamber. A low voltage discharge is sustained in the first chamber, at a potential below the sputtering threshold, producing a plume of plasma that is introduced into the second (main plasma discharge) chamber. The gas pressure in the second chamber is sufficiently low that it operates as a conventional ion source, producing a higher discharge voltage plasma as electrons are accelerated toward a second, more positive anode.

After an electron enters the plasma chamber of an ion thruster, it may strike a neutral atom on its way to the anode, producing an ion and additional electrons that may collide with other atoms. To improve the probability of such a collision, it is preferable to maximize the mean path or distance between the point where the electron enters the chamber and the point where it impacts the anode. In addition, it is desirable to magnetically contain the ionized plasma that results from such collisions. Typically, a plurality of high strength magnets are placed around the periphery of the plasma chamber, defining several magnetic rings stacked above the cathode. The surface of the plasma chamber disposed intermediate the rings comprises the anode. Exemplary of this design is the ion thruster disclosed in U.S. Pat. No. 4,466,242. A further feature of the design is a movable cylindrical cathode magnet, which may be adjusted axially to produce a desired magnetic field at the cathode tip. Each ring of magnets produces a magnetic ring cusp inside the iron anode shell.

Ring magnets are also used in an ion source described in U.S. Pat. No. 4,641,031. A ferromagnetic body surrounds a cathode of the ion source, shielding the cathode from lines of magnetic flux, thereby preventing the magnetic field from obstructing electron emission.

Extraction of the ions from the plasma chamber to produce a focused beam is usually accomplished using a closely spaced perforated accelerator grid and screen grid and, preferably, a decelerator grid. The perforations in each grid must be aligned with precision, and the separation between the two (or three) grids should be minimal to provide optimum beam current. Warpage of one or more of the grids may result in a short circuit path for current to flow between their potential difference. Alignment and warpage concerns thus tend to limit the maximum practical area of conventional ion-optic grid designs.

In U.S. Pat. No. 3,744,247, a single grid plate design is disclosed that includes a layer of dielectric material interposed between a perforated metal grid plate and the plasma chamber. The dielectric material protects the plasma chamber side of the grid plate from sputtering erosion. Another embodiment uses alternating layers of the dielectric material and a metal vapor deposited as a thin film on the dielectric to increase the maximum negative potential difference that may be applied to the grid plate, relative to the positive plasma. The innermost layer of dielectric material assumes a positive potential that is almost equal to that of the plasma inside the chamber, and in effect, becomes the screen grid.

Another version of a single grid plate ion-optic system is disclosed in U.S. Pat. No. 3,697,793. The accelerator grid in that ion-optic system comprises a plurality of bars, having two metal strip electrodes separated by a dielectric glass-filled refractory material, assembled in an "egg crate" configuration. A conventional screen grid is used with the accelerator grid. Optionally, the screen grid may be eliminated and an insulating material may be applied to the bars, forming a nose on the surface of each bar that faces toward the plasma. Different voltages may be applied to the strip electrodes, on each side of the opening in the accelerator grid, to control deflection and to focus the ion beam.

While there are certain benefits that may result from using the ion-optic system of the 3,744,247 patent or that of the 3,697,793 patent, both designs suffer from serious drawbacks. In the former patent, the single grid plate does not properly focus the beam because it lacks a decelerator grid; and, the outer surface of the grid plate is subject to ion erosion. The accelerator grid of the latter patent is unduly complicated, particularly if the design is fully implemented to provide a different potential on each strip electrode.

It is therefore an object of the present invention to more effectively reduce sputtering erosion, magnetically contain the plasma and increase the mean path of electrons, and focus the ion beam, than the prior art devices just described. Advantages of the present invention in effecting each of these functions will be apparent from the attached drawings and the description of the preferred embodiments that follow.

SUMMARY OF THE INVENTION

In accordance with the present invention, an ion accelerator includes a chamber connected to a source of free electrons. Within the chamber are provided means for accelerating the free electrons. In addition, the ion accelerator includes means for introducing a flow of a gas comprising atoms having a neutral charge into the chamber, where the free electrons that have been accelerated may collide with the atoms. Such collisions cause valence shell electrons to be lost by the atoms, producing a plasma of positively charged ions.

One wall of the chamber comprises a metallic grid plate provided with a plurality of spaced-apart perforations. The metallic grid plate is coated on both its inner and outer sides with a layer of an insulating material having a much higher dielectric constant than the grid plate, and is connected to an electric potential that is substantially more negative than the positively charged ions. Ions drifting into the vicinity of the metallic grid plate are thus accelerated toward it and pass out of the chamber through the perforations. The surface of the insulating material on the inner side of the metallic grid plate has an electric potential approximately equal to that of the plasma, and thus acts as a screen grid. As the ions pass through the perforations of the metallic grid plate, means are provided for neutralizing their positive charge, producing a neutral plasma and causing substantially a neutral potential to appear on the surface of the outer layer of insulating material coating the grid plate. Both layers of insulating material protect the metallic grid plate from erosion by charged ions, and insulate the chamber against thermal and electrical losses. The layer of insulating material on the outer surface of the metallic grid plate also functions as a decelerator grid.

In one preferred embodiment, substantially the entire inner surface of the chamber is coated with a layer of the insulating material, which has an electric potential substantially equal to that of the plasma inside the chamber. The insulating layer reduces the loss of ions and free electrons that would otherwise occur upon their contact with a metallic conductive surface, and thermally insulates the plasma, reducing heat loss through the chamber walls.

The means for accelerating free electrons within the chamber comprise an anode disposed proximate a periphery of the metallic grid plate, having an applied electric potential substantially more positive than the source of free electrons. Preferably, the anode comprises an annular ring. At least a portion of the anode's surface is preferably coated with a layer of the insulating material.

In another aspect of the present invention, a free electron source, resistant to sputtering erosion, comprises a metallic electron emitter having a substantial portion of its surface coated with a layer of insulating material that has a dielectric constant much higher than that of the electron emitter, and means for initiating heating of the metallic electron emitter and emission of free electrons from it. Disposed around the metallic electron emitter is an enclosure. A passage into the enclosure is provided for admitting a flow of gas comprising neutrally charged atoms. An orifice disposed in the enclosure proximate an end of the electron emitter provides a passage for the free electrons and neutrally charged atoms to exit into the chamber. In addition, the orifice restricts and thus controls the flow of gas and related operating parameters of the ion accelerator. The free electrons collide with the atoms in the chamber, producing a plasma of positively charged ions.

Since the layer of insulating material on the electron emitter has an electric potential approximately equal that of the plasma, it protects the electron emitter from sputtering erosion. In addition, the layer of insulating material thermally insulates the electron emitter, so that it operates with less heat loss and at a lower voltage, thereby improving its efficiency.

In one embodiment, the enclosure preferably includes a plurality of orifices disposed proximate the end of the electron emitter, oriented generally in a radial direction about its central longitudinal axis. These orifices are operative to direct positively charged ions away from a negatively charged surface lying on the axis. The means for initiating heating of the emitter tube preferably comprise a tickler electrode, disposed in close proximity to the electron emitter, and having an applied electric potential that is much more positive than the potential of the electron emitter. The potential difference between the electron emitter and the tickler electrode causes free electrons to be emitted from the electron emitter, and accelerates them toward the tickler electrode. A portion of the ions formed by the collision of the free electrons with the atoms of gas are electrostatically attracted to a portion of the surface of the metallic electron emitter that is not coated with the layer of insulating material. The ions heat the electron emitter as they collide with it and give up their energy upon recombination. Once the electron emitter is sufficiently hot to thermally emit free electrons, an anode disposed in an adjacent connected chamber is energized with an electric potential substantially more positive than the electron emitter, and the tickler electrode is de-energized. The anode then attracts the free electrons, instead of the tickler electrode.

In yet a further aspect of the invention, a magnetic confinement deflector is provided in the ion accelerator for increasing the distance that the free electrons travel inside the chamber prior to impacting the anode and for containing the plasma. The magnetic confinement deflector comprises a plurality of first bar magnets disposed in a spaced apart circular array defining a "picket fence" around the source of free electrons. A pole face of each of the first bar magnets is tangentially aligned with a first section of the chamber. One edge of each first bar magnet is disposed proximate the source of free electrons; an opposite edge is distal from the source; and a planar surface of each of the first bar magnets is radially aligned about the source.

The pole faces of adjacent first bar magnets that are tangentially aligned with the first section alternate in polarity, so that the magnetic field between pole faces of adjacent first bar magnets acts to deflect the free electrons into a helical path as the free electrons are accelerated toward the anode. Since the helical path is much longer than a straight line between the source of free electrons and the anode, the probability of a collision between an electron and the atoms of gas in the chamber is increased.

The magnetic deflector further comprises a plurality of second bar magnets, disposed in a spaced apart circular array defining a picket fence about an accelerator grid. A pole face of each of the second bar magnets is tangentially aligned with a second section of the chamber. Edges of the second bar magnets distal from the accelerator grid are disposed proximate the edges of the first bar magnets that are distal from the source of free electrons. Pole faces of adjacent bar magnets that are tangentially aligned with the second section alternate in polarity. The magnetic field between the pole faces of adjacent second bar magnets likewise deflects the free electrons into a helical path as the electrons are accelerated toward the anode.

In one preferred form, the magnetic confinement deflector includes a plurality of pole pieces disposed inside the chamber, each pole piece being aligned with the pole face of one of the first and second bar magnets. The pole pieces act to concentrate the magnetic field inside the chamber, permitting the bar magnets to be disposed outside the chamber, where they are protected from heat generated by the plasma.

The pole pieces are coated with a layer of insulating material having a much higher dielectric constant than the pole pieces, protecting them from erosion caused by collisions with free electrons and ions. A suitable insulating material may be selected from the group consisting of metallic oxides, metallic nitrides, and ceramics, and should have a dielectric strength in excess of 100 volts per mil.

DISCLOSURE OF THE PREFERRED EMBODIMENTS

Figure 1:
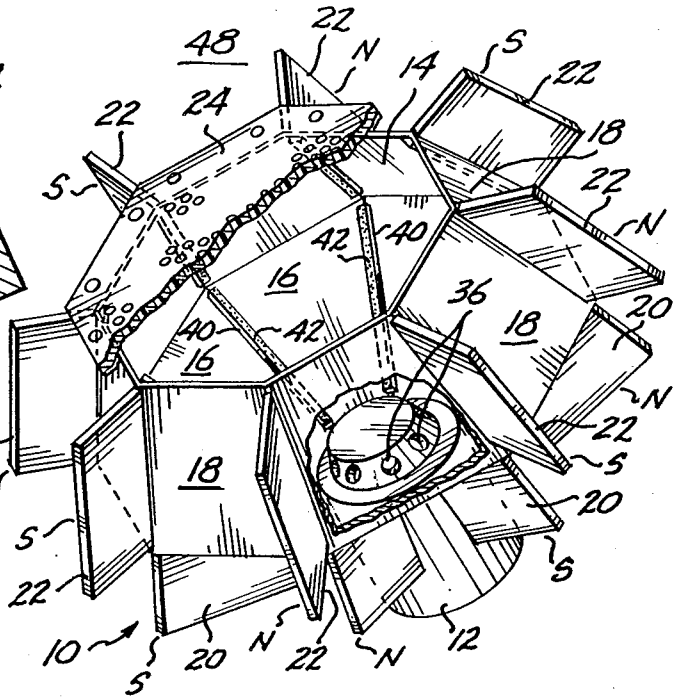
FIG. 1 is a cutaway, isometric view of a first embodiment of the ion thruster.
Figure 2:
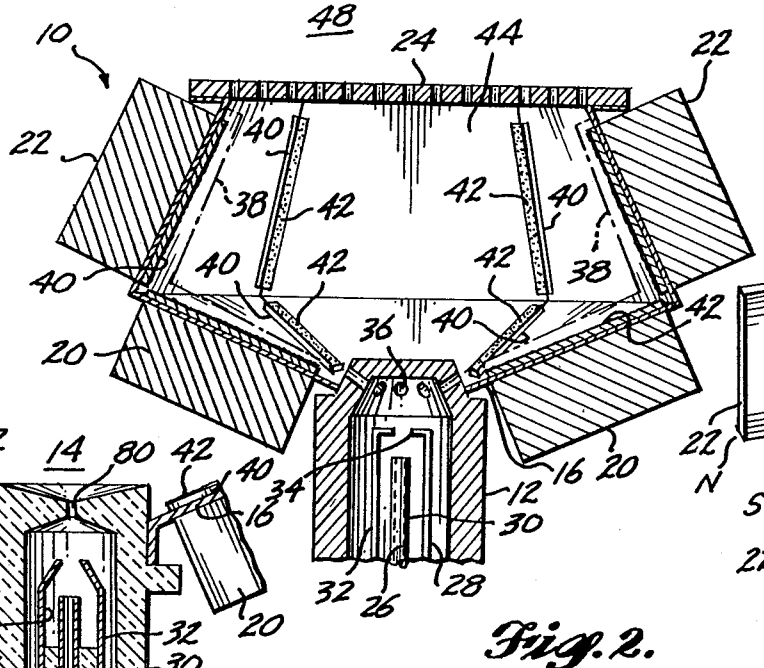
FIG. 2 is a cross-sectional view of the first embodiment.

A first preferred embodiment of an ion thruster is generally represented by reference numeral 10 in FIGS. 1 and 2. Ion thruster 10 includes a cathode chamber 12, from which free electrons flow into an attached ionization chamber 14. The free electrons enter ionization chamber 14 along with a flow of ionizable gas atoms through a plurality of radially aligned orifices 36, which are spaced apart around one end of cathode chamber 12. The free electrons are accelerated by a positive potential applied to the interior surface of ionization chamber 14, causing the electrons to collide with atoms of the gas with sufficient kinetic energy to create ions. The positively charged ions are accelerated toward a negatively charged perforated grid plate 24, pass through the grid plate, and exit in a focused beam, providing thrust in the opposite direction.

Ionization chamber 14 includes eight wall sections 16, each of generally trapezoidal shape, joined along their edges to form an octagonal bowl that diverges away from cathode chamber 12. Eight wall sections 18, also of trapezoidal shape, are joined to all sections 16 along their longer base edges. Wall sections 18 converge toward perforated grid plate 24, which covers the side of ionization chamber 14 that is opposite cathode chamber 12.

Eight bar magnets 20 are disposed at each corner where adjacent wall sections 16 are joined, forming what is referred to as an axial geodesic "picket fence" arrangement that extends circularly about cathode chamber 12. The planar surfaces of bar magnets 20 are generally radially aligned around the cathode chamber, with their magnetic poles disposed at the radially inner and outer edges of the bar magnets. One magnetic pole face of each bar magnet 20 is thus tangent to the corner between two wall sections 16. In addition, the magnetic pole faces of adjacent bar magnets 20 that are in contact with ionization chamber 14 alternate north and south polarity, so that a magnetic field extends between the opposite pole faces of adjacent bar magnets. The polarity of the magnetic pole faces is indicated in FIG. 1 by the letters N and S, representing the north and south poles, respectively.

Similarly, eight bar magnets 22 are radially disposed around ionization chamber 14, at the corners where wall sections 18 are joined, generally aligned with bar magnets 20. Bar magnets 22 also define an axial geodesic picket fence arrangement extending circularly about grid plate 24. One of the magnetic pole faces of each bar magnet 22 is also disposed along the edge of the magnet that is in contact with and tangentially aligned with the corner joints between wall sections 18. The same alternating magnetic field polarity pattern is used for bar magnets 22 as for bar magnets 20, i.e., the same pole is disposed along the corner extending between corresponding adjacent wall sections 16 and 18, as shown in FIG. 1. Bar magnets 20 and 22 preferably comprise a samarium cobalt alloy, or other alloy selected to produce bar magnets having a relatively high magnetic flux density.

Inside ionization chamber 14, overlying the corners between adjacent wall sections 16 and the corners between adjacent wall sections 18 are a plurality of pole pieces 40. The pole pieces are aligned parallel to the pole faces of each of bar magnets 20 and 22 and are operative to concentrate the magnetic field at the pole face, drawing it through wall sections 16 and 18, and thereby increasing the strength of the magnetic field inside the ionization chamber. Bar magnets 20 and 22 are placed outside the ionization chamber to protect them from the heat of the plasma developed during operation of ion thruster 10. However, placing the bar magnets outside the ionization chamber tends to reduce the magnetic field strength between the poles of adjacent bar magnets 20 and between the poles of adjacent bar magnets 22. The pole pieces are used to concentrate the magnetic field inside the ionization chamber to a shallow depth identified by dash line 38, thereby counteracting this decrease in field strength.

Free electrons entering the ionization chamber from cathode chamber 12 are attracted to a positive potential applied to an anode comprising the inner surface of wall sections 16 and 18. As a negatively charged electron is accelerated toward the wall sections, the magnetic field extending between adjacent bar magnets 20 and between adjacent bar magnets 22 interacts with the moving charge, causing the electron to experience a force directed generally at a right angle to its forward velocity. This force is equal the vector cross product of the electron's velocity and the magnetic field. In response to this force, the electrons are caused to spiral toward the anode in a helical path. The helical path followed by the electrons extends the distance over which they travel prior to striking the interior surface of wall sections 16 and 18, and thus increases the probability that the electrons may strike an atom, creating an ion by knocking one or more valence electrons free. Valence electrons released by the collision of a free electron with a gas atom are also accelerated toward the anode, impacting other gas atoms in a cascade effect. As more atoms are ionized, the efficiency of ion thruster 10 increases.

Since the magnetic field lines that confine the plasma within ionization chamber 14 bend laterally away from a pole piece toward the pole pieces of adjacent bar magnets, the surfaces of pole pieces 40 are not well protected by the magnetic field and would normally be exposed to erosion due to impacts by high-energy electrons or ions. Accordingly, the present invention provides for a dielectric coating 42 to be applied to the face of pole pieces 40, to protect them from sputtering erosion. Dielectric coating 42 electrically insulates the pole pieces without affecting the magnetic field.

The surface of the dielectric coating 42 on pole pieces 40 takes on the same potential as the plasma so that the pole pieces appear to have a neutral charge and thus do not attract either electrons or ions. In the preferred embodiment, the dielectric coating applied to pole pieces 40 is titanium dioxide; however, other dielectric insulating materials might be used, such as other metallic oxides, metallic nitrides or ceramics. Dielectric insulating material 42 should preferably have a dielectric strength in excess of 100 volts per mil.

As shown in FIG. 2, cathode chamber 12 includes a propellant gas feed passage 26, disposed in the center of a tickler electrode 30. This passage is connected to a source of an ionizable gas. Although xenon is preferred, argon, mercury vapor or other ionizable gases may also be used. The flow of the gas through the propellant gas feed passage is metered to a relatively low rate. In the preferred embodiment, xenon gas is supplied at a flow rate of approximately 14 standard cubic centimeters per second per amp equivalent.

An emitter tube 28 surrounds tickler electrode 30, and its upper end includes an opening defined by the edges of an inwardly extending lip 34. The outer surface of emitter tube 28 is coated with a dielectric coating 32 preferably comprising titanium dioxide, but alternatively comprising any of the other materials used for dielectric coating 42. Dielectric coating 32 protects the exterior surfaces of emitter tube 28 from sputtering erosion in the same manner as dielectric coating 42 protects the pole pieces, and it thermally insulates the emitter tube against radiated heat loss, so that the emitter tube operates more efficiently as a source of electrons.

When ion thruster 10 is first energized, a relatively high positive voltage gradient is impressed on tickler electrode 30 with respect to emitter tube 28. The voltage gradient establishes a discharge of electrons toward tickler electrode 30 from the interior surface of emitter tube 28, particularly from lip 34. Electrons emitted from emitter tube 28 are accelerated toward the positively charged tickler electrode, occasionally colliding with atoms of the gas flowing through propellant gas feed passage 26. The atoms are ionized by the collision, forming a localized plasma that heats emitter tube 28. Once the plasma is established, the positive potential applied to the tickler electrode is de-energized, allowing the electrode to float in potential. The tickler electrode then assumes the same potential as the plasma that is near it, just as if it were coated with a dielectric material, thereby preventing erosion due to ions impacting its surface. Before the tickler electrode is de-energized, a positive potential is applied to the anode inside ionization chamber 14, i.e., to the interior surfaces of wall sections 16 and 18. Free electrons emitted from emitter tube 28, along with ions and atoms of gas flowing out of propellant gas feed passage 26, pass through orifices 36 and into the lower pressure ionization chamber 14. Some of the atoms are ionized by collision with the free electrodes as the electrons are accelerated toward the anode, creating the plasma as previously described.

Figure 3:
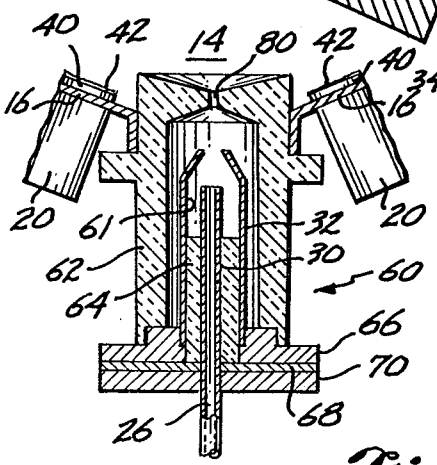
FIG. 3 is a cross-sectional view of a second embodiment of the electron emitter cathode.

In accord with the present invention, the physical configuration of cathode chamber 12 is not limited to that disclosed in FIG. 2. For example, a second embodiment of a cathode chamber generally identified by reference numeral 60 is shown in FIG. 3. The same reference numerals are used to identify elements of the second embodiment of the cathode chamber, which are common to the first embodiment. Cathode chamber 60 therefore includes a tickler electrode 30 through which extends a propellant gas feed passage 26. An exterior wall 62 of cathode chamber 60 comprises a boron nitride insulator material. Exterior wall 62 has a slightly different configuration than the enclosure of cathode chamber 12, but is otherwise similar in function. A metallic plate 66 comprises an upper part of a base assembly of cathode chamber 10 and is electrically and mechanically connected to an emitter tube 61 that extends into the cathode chamber. The distal end of the emitter tube defines an opening through which free electrons, ions and ionizable gas atoms pass prior to flowing through an orifice 80 that is disposed in the upper end of cathode chamber 60. Orifice 80 tends to restrict the flow of ionizable gas into ionization chamber 14. The pressure inside cathode chamber 60 is maintained at approximately 2 torr for as long as the tickler electrode 30 is energized with a positive potential. After the tickler electrode is floated in potential, the pressure within cathode chamber 12 is increased to approximately 4 to 10 torr. A flow restrictive orifice is necessary, since the pressure inside ionization chamber 14 is only about 1/10 torr.

Emitter tube 61 is electrically grounded by connection to metallic plate 66, whereas tickler electrode 30 is initially energized with a positive potential applied through metallic plate 70. A boron nitride insulator 68 separates metallic plates 66 and 70, preventing them from electrically shorting together. In addition, a cylindrical boron nitride insulator 64 electrically separates tickler electrode 30 from the interior surface of emitter tube 61 over a substantial portion of their length. The outer surface of emitter tube 61 is coated with dielectric coating 32. Dielectric coating 32 is again used to prevent sputtering erosion of emitter tube 61 by high-energy ions and to thermally insulate the emitter tube to improve its operating efficiency.

Figure 5:
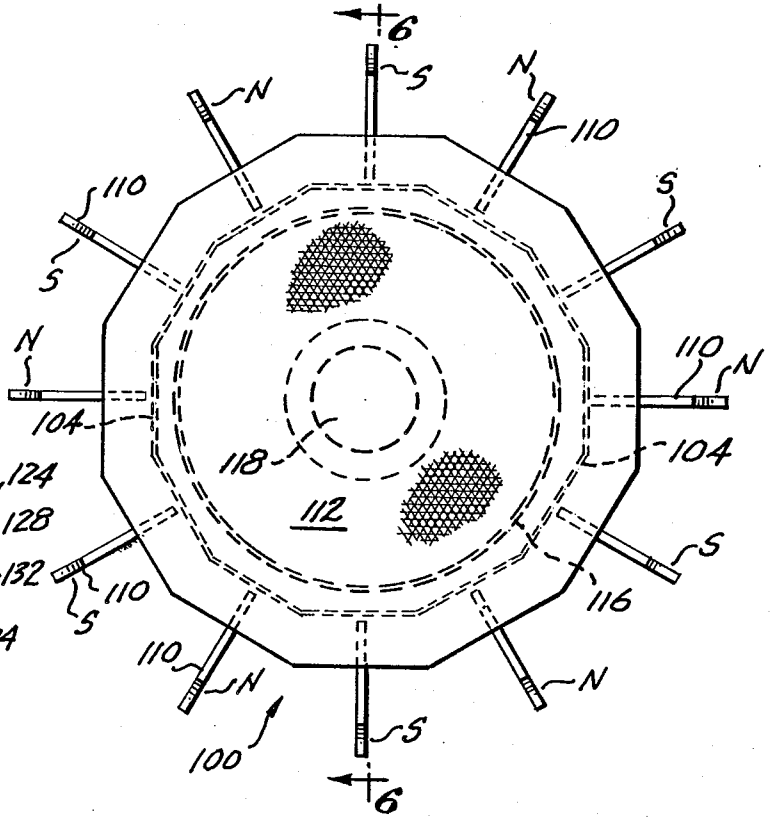
FIG. 5 is a top plan view of a second embodiment of the ion thruster.
Figure 6:
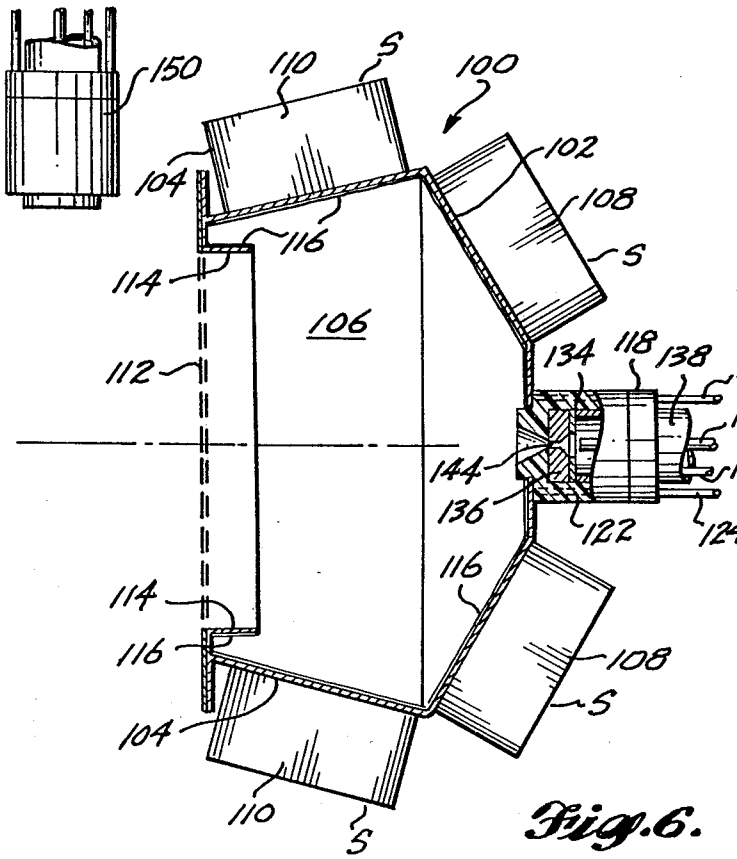
FIG. 6 is a cross-sectional view of the second embodiment of the ion thruster.

Turning now to FIGS. 5 and 6, a second embodiment of an ion thruster is shown, generally identified by reference numeral 100. Ion thruster 100 is similar in many respects to ion thruster 10; however, it includes an ionization chamber 106 comprising twelve wall sections 102 and twelve wall sections 104, each having a trapezoidal shape. Wall sections 102 diverge away from a cathode chamber 118, and are each joined along their longer base edge to one of wall sections 104. Wall sections 104 converge toward a grid plate 112 that covers one end of the ionization chamber.

Bar magnets 108 are radially aligned in an axial geodesic picket fence arrangement about cathode chamber 118, each of the bar magnets having a magnetic pole face tangentially disposed in contact with the center of one of wall sections 102. A plurality of bar magnets 110 are similarly arranged, so that a magnetic pole face extending along each bar magnet 110 is tangentially in contact with the center of each of wall sections 104. The magnetic pole faces of adjacent bar magnets 108 and 110 alternate in polarity, with the polarity of corresponding bar magnets 108 and 110 disposed on joined wall sections 102 and 104 being the same, as shown in FIGS. 5 and 6. The planar surfaces of corresponding bar magnets 108 and 110 are aligned with each other, being radially aligned relative to the cathode chamber and to the central axis of ionization chamber 106.

The poly-conic shape of ionization chamber 106 is not arbitrarily selected. This shape provides significantly higher mechanical strength and stiffness relative to its weight, compared with prior designs. For a given ionization chamber volume, the surface area is less than previous designs, thereby minimizing ion recombination losses and maximizing operating efficiency. The shape also tends to direct neutral atoms into the plasma volume, where they may be ionized by collisions with electrons, and minimizes losses through the grid.

The anode of ion thruster 100 comprises an annular ring 114 that depends into ionization chamber 106 from the periphery of the grid, proximate to and concentric with an opening defined by the converging ends of wall sections 104. Unlike ion thruster 10, ion thruster 100 does not include pole pieces 40, but instead, uses additional bar magnets, more closely spaced around the periphery of ionization chamber 106 than in the first embodiment. It should be noted that the spacing between the radially inner pole faces of adjacent bar magnets 108 and between the radially inner pole faces of adjacent bar magnets 110 must be less than the distance between the opposite pole faces of each bar magnet (i.e., the radial length or "depth" of each magnet) to insure that the magnetic field intensity between pole faces of adjacent bar magnets is sufficiently strong to deflect free electrons into a helical path within ionization chamber 106, and to properly confine the plasma therein. The bar magnets again comprise samarium cobalt alloy, having a relatively high magnetic flux density. Since the bar magnets are disposed outside of ionization chamber 106, they are protected from the heat produced by the plasma within ionization chamber 106. Although the preferred embodiment uses twelve bar magnets 108 for the lower portion and a like number of bar magnets 110 for the upper portion of ionization chamber 106, any even number may be used, depending on the number of wall sections, so long as the depth of the bar magnets is greater than the separation between adjacent pole faces.

Ion thruster 100 represents a substantial advance over ion thruster 10, providing much improved sputtering erosion protection for internal metallic surfaces within the ionization chamber. In the first embodiment of ion thruster 10, only the exposed surfaces of the pole pieces were coated with a dielectric insulating material. In ion thruster 100, except for the radially inner surface of annular ring 114, all internal and external metal surfaces of ionization chamber 106 are coated with a thin film of dielectric material 116. (The anode must include an exposed metallic surface having a positive charge to attract and accelerate free electrons emitted from cathode chamber 118). During operation of ion thruster 100, dielectric material 116 attains substantially the same potential as the plasma within ionization chamber 106. Since the dielectric coating is at the same potential, high-energy ions and electrons are not attracted to it, and the surfaces that it covers are protected from sputtering erosion. The dielectric coating improves thermal emissivity, permitting operation of the ion thruster at a lower temperature, thereby improving operating efficiency and protecting the bar magnets from degradation due to exposure to excessive temperatures. Since the dielectric coating on the outer surface assumes the potential of the adjacent space, it eliminates the need for a zero voltage ground screen, normally required in prior ion thruster designs. The dielectric coating also acts as a thermal insulator, reducing heat loss. Preferably, dielectric coating 116 comprises titanium dioxide, but it will be understood that the alternative dielectric materials described above might also be used.

Free electrons entering ionization chamber 106 are attracted and accelerated toward a positive potential applied to the radially inner surface of the anode (annular ring 114), but as the electrons approach the walls of the ionization chamber, they interact with the magnetic field between the pole faces of adjacent bar magnets, thereby extending the mean free path of the electrons and increasing the probability of a collision between each of the electrons and an atom, as explained above.

Figure 4:
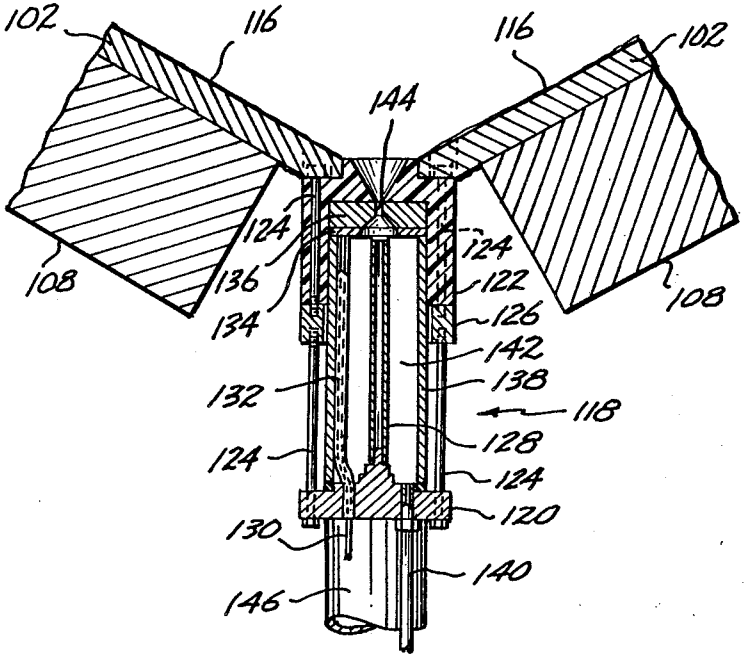
FIG. 4 is a cross-sectional view of a third embodiment of the electron emitter cathode.

Cathode chamber 118 is shown in greater detail in FIG. 4. It includes a boron nitride base 120 connected to a support 146 that extends to an underlying body (not shown). Base 120 is attached to a boron nitride cap 122 by means of an intermediate annular ring 126. A plurality of bolts 124 extend downwardly from wall sections 102, through boron nitride cap 122, and are threaded into intermediate ring 126. In addition, bolts 124 extend upwardly through base 120 and are threaded into the intermediate ring from the opposite direction. As bolts 124 are tightened, they apply a compressive force against each end of a quartz tube 138 disposed between cap 122 and base 120. The quartz tube sealingly encloses an emitter tube 128.

A tickler electrode comprising a tantalum washer 134 is disposed inside quartz tube 138, proximate the upper end of emitter tube 128, and adjacent a boron nitride orifice insert 136. During start-up of ion thruster 100, tantalum washer 134 is connected to a positive potential by means of a tickler lead 130 that extends through base 120 in an alumina tube 132.

A propellant feed line 140 also penetrates base 120, and is connected in fluid communication with a regulated or metered flow of an ionizable gas, preferably xenon. The gas flows through an annular space 142 between emitter tube 128 and quartz tube 138. An orifice 144, disposed in the center of boron nitride orifice insert 136, limits the flow of the gas from the higher pressure cathode chamber into the relatively lower pressure ionization chamber 106. (During operation of ion thruster 100, the pressure within the ionization chamber is approximately 1/10 torr, as described above with respect to the first embodiment of the ion thruster.)

Figure 7:
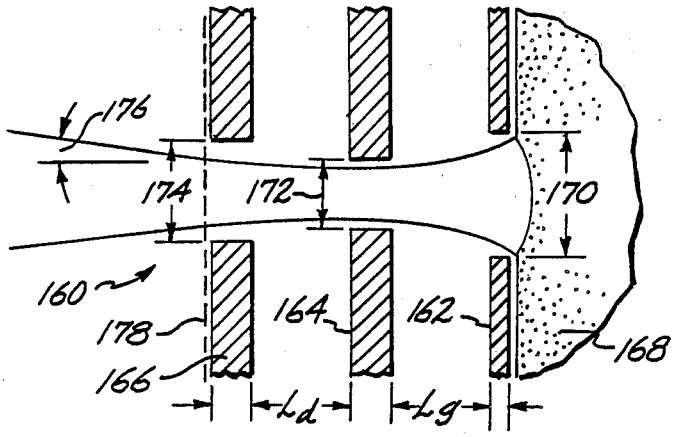
Fig. 7. (PRIOR ART)
FIG. 7 is a cross-sectional view of a prior art ion-optic grid having three elements.

In a conventional ion thruster, positively charged ions comprising the plasma developed within the ionization chamber are attracted toward an ion-optic grid having an applied negative charge. FIG. 7 illustrates a portion of a prior art ion-optic grid, generally denoted by reference number 160. As shown therein, an accelerator grid 164 is disposed intermediate and spaced apart from a screen grid 162 by a distance $L_g$, and from a decelerator grid 166 by a distance $L_d$. A plasma 168 of positively charged ions lies inside an ionization chamber (not shown), disposed to the right of the screen grid. The screen grid, accelerator grid and decelerator grid each include a plurality of perforations, which must be accurately aligned to properly focus the beam of ions emerging from the confined plasma. Focusing of the beam is controlled by the relative size and spacing of aligned perforations in the respective grids. Thus, screen grid 162 has a perforation diameter defined by reference numeral 170 that is somewhat larger than a diameter 172 of a coaligned perforation in accelerator grid 164. Intermediate in size between the diameters 170 and 172 is the diameter 174 of a perforation through the decelerator grid. As the beam of ions emerges from the decelerator grid, the relative dimension of the three aligned grid perforations causes it to diverge from the alignment axis of the perforations, through an angle 176.

The potential difference between accelerator grid 164 and screen grid 162 is typically several thousand volts, and the decelerator grid is normally several hundred volts more positive than the accelerator grid. According to Childs Law, the beam current from an ion thruster increases as the spacing between the accelerator grid and screen grid ($L_g$) decreases. Therefore, the spacing $L_g$ should be as small as possible. However, any warping or buckling of grids 162, 164 or 166 is likely to cause a short circuit, rendering the ion thruster virtually inoperative.

Since screen grid 162 is operated at a positive potential only slightly more negative than the anode, it is likely to attract ions that have been accelerated to a relatively high velocity, subjecting the screen grid to sputtering erosion. Similarly, negatively charged accelerator grid 164 is subject to sputtering erosion due to collisions with high-energy positive ions. During the extended operation of a prior art ion thruster, sputtering erosion of the grids may substantially degrade their performance in focusing the ion beam.

Figure 8:
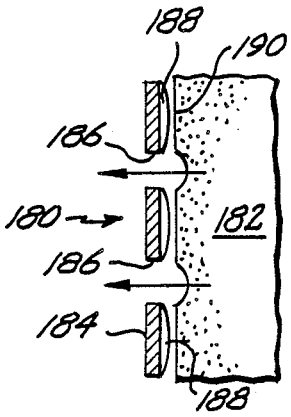
Fig. 8. (PRIOR ART)
FIG. 8 is a cross-sectional view of a portion of a prior art ion-optic grid plate having a dielectric coating on its inner surface.

FIG. 8 shows a portion of an improved prior art single grid plate ion-optic system, generally denoted by 180, in which an attempt was made to solve the above-identified problems. A plasma 182 includes positively charged ions which exit an ionization chamber (not shown) through a plurality of perforations 186 formed in an accelerator grid plate 184. A negative charge is impressed on accelerator grid plate 184 relative to the positive charge of plasma 182, so that positive ions are accelerated from plasma 182 through perforations 186. A dielectric coating 188 of aluminum oxide or other dielectric material is flame sprayed on the inner surface of the accelerator grid (facing toward plasma 182). The surface of dielectric coating 188 assumes a positive potential nearly equal in value to that of the plasma, and thus functions as a screen grid. Prior art ionization optic system 180 does not include a decelerator grid, and does not protect the outer surface of accelerator grid 184 from sputtering erosion due to impacts by high-energy positively charged ions. Therefore, it represents only a partial solution to the problems of the prior art ion-optic system illustrated in FIG. 7.

Figure 9:
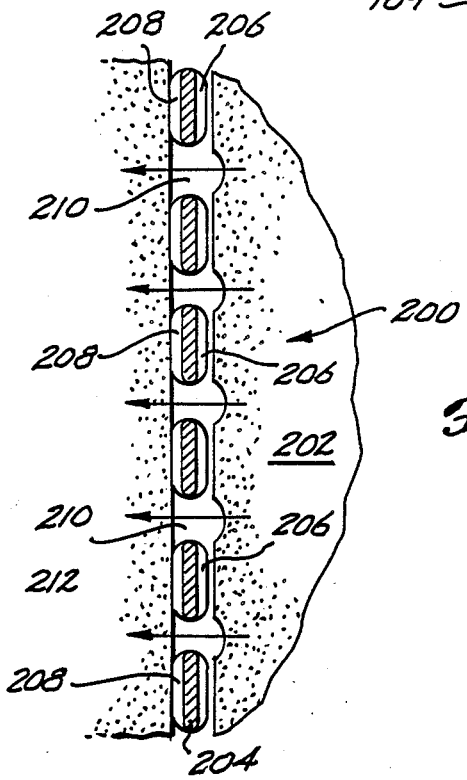
FIG. 9 is a cross-sectional view of a portion of the ion-optic grid of the present invention, coated with dielectric material on both sides.

Referring now to FIG. 9, an ion-optic system generally denoted by reference number 200 is illustrated in accordance with the present invention. Ion-optic sysem 200 includes an accelerator grid plate 204 in which are formed a plurality of perforations 210. A plasma 202 is disposed to the right of the accelerator grid plate, representing the plasma inside either ionization chamber 14 or ionization chamber 106. The surface of accelerator grid plate 204 facing plasma 202 is coated with a dielectric coating 206, while the outer surface, which faces away from plasma 202, is coated with a dielectric coating 208. Dielectric coatings 206 and 208 comprise titanium dioxide in the preferred embodiment. However, other dielectric materials having a dielectric constant in excess of 100 volts per mil may also be used, as discussed above. In the preferred embodiments of ion thrusters 10 and 100, accelerator grid 204 is charged to a potential of −500 volts DC. Positively charged ions comprising plasma 202 are accelerated through perforations 210, forming a focused beam as they emerge into space 212, adjacent the outer surface of dielectric coating 208.

Just as described with respect to dielectric coating 188 of prior art optic system 180 (shown in FIG. 8), dielectric coating 206 assumes a positive potential on its surface, which is approximately equal to the positive potential of plasma 202, and thus functions as a screen grid. Further, dielectric coating 208 tends to assume a potential approximately equal to that of the net charge in space 212, which, as will be disclosed hereinbelow, is substantially neutral. As a result, dielectric coating 208 functions as a decelerator grid.

By coating both the inner and outer surfaces of accelerator grid 204 with the dielectric material comprising coatings 206 and 208, the accelerator grid is much more effectively protected against erosion due to impacts by high-energy positive ions. In addition, dielectric coating 208 provides a decelerator grid, without requiring use of a separate grid plate as was necessary in prior art ion-optic grid 160. There is no possibility of shorting between grid plates in ion-optic system 200, since only one plate is used; yet, it provides the improved efficiency of an ion-optic system having very closely spaced screen, accelerator and decelerator grids.

Turning back to FIG. 6, a cathode chamber 150 is shown disposed outside ionization chamber 106, at one side of grid plate 112. Cathode chamber 150 is substantially a duplicate of cathode chamber 118, including each of the elements of that electron source as previously disclosed above. Accordingly, these elements are not identified with respect to cathode chamber 150. However, it will be understood that cathode chamber 150 functions to provide a source of negatively charged electrons, which are emitted into the space adjacent the outer surface of grid plate 112. This space corresponds to space 212 identified in FIG. 9, and it will be understood that grid plate 112 is constructed as shown and described with respect to ion-optic system 200.

Free electrons emitted by cathode chamber 150 provide a neutralizing negative charge, offsetting positively charged ions emerging through perforations 210 in accelerator grid 204 (i.e., through grid plate 112), so that the net charge of a body to which ion thruster 100 (or ion thruster 10) is attached remains substantially zero. Since the potential of space 212 is substantially neutral as a result of the combined offsetting charge of the electrons and the positively charged ions, the outer surface of dielectric coating 208 assumes a potential that is the same as the space charge, i.e., approximately equal to zero, eliminating erosion of the grid from space plasma ions. Cathode chamber 150 does not directly affect the efficiency of either ion thrusters 10 or 100; however, its operation consumes both a supply of ionizable gas and electric current to produce free electrons.

Figure 10:
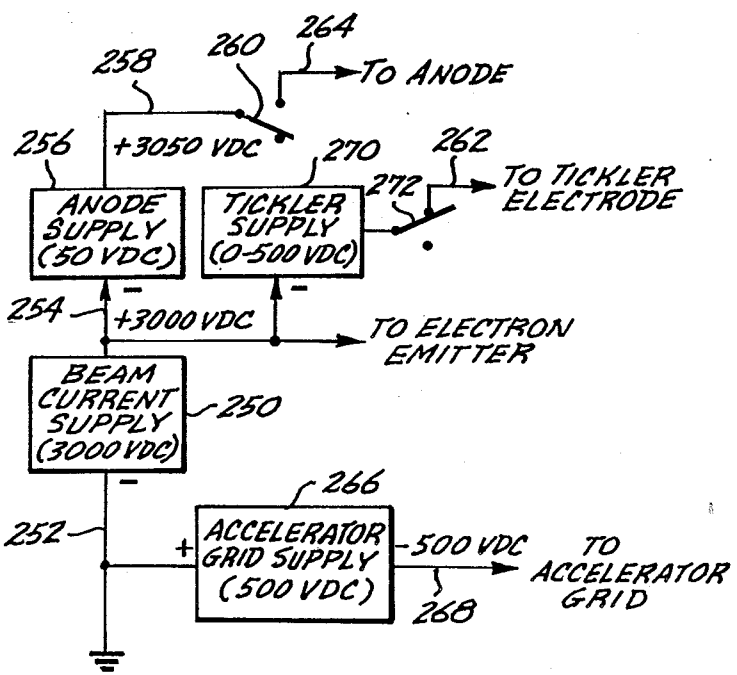
FIG. 10 is a schematic block diagram illustrating power supplies used with the ion thruster.

FIG. 10 illustrates in a block diagram the various power supplies used to energize ion thrusters 10 and 100 at a particular operating level. The voltage output from each power supply may be adjusted to modify the operating parameters of the ion thrusters. A beam current supply 250 includes a negative terminal connected to ground potential through a lead 252 and a positive terminal energized at approximately 3000 volts DC, which is connected via lead 254 to a negative terminal of anode supply 256 and to a negative terminal of a tickler supply 270. Lead 254 is also connected to the electron emitter, raising its potential to approximately 3000 volts DC relative to ground. The anode supply produces an additional 50 volts DC, and is connected in series with the beam current supply, relative to ground, so that the potential of its output with respect to ground is approximately 3050 volts DC. The positive terminal of anode supply 256 is connected via lead 258 to an S.P.S.T. switch 260. During start-up of the ion thruster, switch 260 is in an open position and current is supplied to the tickler electrode from the 500 volts DC tickler supply 270, which is connected thereto through an S.P.S.T. switch 272. After the electron emitter has started to emit electrons, switch 260 is closed to connect lead 258 to a lead 264, thus applying the 3050 volts DC potential to the anode, and switch 272 is opened to disconnect tickler supply 270 from a lead 262, which is connected to the tickler electrode.

Lead 252 also connects the positive terminal of an accelerator grid supply 266 to ground potential. A −500 volts DC potential on the negative terminal of the accelerator grid supply is conveyed through a lead 268 to the accelerator grid (204 in FIG. 9). Separate voltages need not be supplied for a screen grid or decelerator grid, since those potentials are developed on the exterior surfaces of dielectric coatings 206 and 208, respectively. While not shown in FIG. 10, leads 254 and 262 are also used to energize the electron emitter and tickler electrode of cathode chamber 150, producing the free electrons required to neutralize the affect of the plasma beam emerging from grid plate 112 (shown in FIG. 6). The power supply of FIG. 10 is used for each of ion thrusters 10 and 100, regardless of which embodiment of the cathode chamber is used; however, the voltages output from the various power supplies 250, 256, 266 and 270 may be adjusted as required to optimize operation of the ion thruster, or some parameter of its performance.

While the present invention has been disclosed with respect to preferred embodiments and variations thereof, those of ordinary skill in the art will understand that further modifications to these embodiments may be made within the scope of the claims that follow. Accordingly, the scope of the invention is not in any way to be limited by the disclosure of the preferred embodiments, but should be entirely determined by reference to the claims.

The embodiments of the invention in which an exclusive property or privilege is claimed are defined as follows:

1. An ion accelerator apparatus comprising:

(a) a source of free electrons;

(b) a chamber connected to the source of free electrons;

(c) means for accelerating the free electrons within the chamber;

(d) means for introducing a flow of a gas comprising atoms having a neutral charge into the chamber, the accelerated free electrons colliding with the atoms of the gas causing valence shell electrons to be lost by the atoms, producing therefrom a plasma of positively charged ions; and (e) a metallic grid plate comprising one wall of the chamber and provided with a plurality of spaced apart perforations extending therethrough, the grid plate being coated on both its inner and outer sides with a layer of an insulating material having a much higher dielectric constant than the metallic grid plate, the grid plate being connected to an electric potential substantially more negative than the positively charged ions so that ions drifting into the vicinity of the metallic grid plate are accelerated toward it, passing out of the chamber through the perforations; the surface of the layer of insulating material on the inner side of the metallic grid plate having an electric potential approximately equal to that of the plasma and thus acting as a screen grid, both layers of insulating material protecting the metallic grid plate from erosion by charged ions and insulating the chamber against thermal and electrical losses.

2. The apparatus of claim 1, further comprising means for neutralizing the positive charge on the ions immediately as they pass through the perforations of the metallic grid plate, producing a neutral plasma, causing substantially a neutral potential to appear on the surface of the layer of insulating material disposed on the outer side of the metallic grid plate, the layer of insulating material on the outer side of the metallic grid plate functioning as a decelerator grid.

3. The apparatus of claim 1, wherein substantially the entire inner and outer surfaces of the chamber are each coated with a layer of said insulating material, the insulating material on the inner surface of the chamber having a charge substantially equal that of the plasma inside the chamber, thereby reducing the loss of ions and free electrons that would otherwise occur upon contact of the ions and free electrons with a metallic conductive surface, the insulating material on the outer surface having a charge substantially equal to a surrounding space charge, said layers of insulating material also thermally insulating the plasma, reducing heat loss through the chamber walls.

4. The apparatus of claim 1, wherein the means for accelerating free electrons within the chamber comprise an anode disposed proximate the periphery of the metallic grid plate, having an applied electric potential substantially more positive than the source of free electrons.

5. The apparatus of claim 4, wherein the anode comprises an annular ring.

6. The apparatus of claim 4, wherein at least a portion of the anode's surface is coated with a layer of the insulating material.

7. The apparatus of claim 1, wherein the insulating material is selected from the group consisting of metallic oxides, metallic nitrides, and ceramics, and has a dielectric strength in excess of 100 volts/mil.

8. In an ion accelerator, a free electron source resistant to sputtering erosion, comprising:

(a) a metallic electron emitter having a substantial portion of its outer surface coated with a layer of insulating material that has a dielectric constant much higher than that of the metallic electron emitter;

(b) means for initiating heating of the metallic electron emitter and emission of free electrons therefrom; and (c) an enclosure disposed around the metallic electron emitter and spaced apart from the outer surface of the metallic electron emitter so that the layer of insulating material does not contact the enclosure, a passage into the enclosure being provided for admitting a flow of a gas comprising atoms having a neutral charge, and an orifice being disposed in the enclosure proximate an end of the metallic electron emitter for restricting and thus controlling the flow of gas and related operating parameters of the ion accelerator, the flow of atoms of gas and free electrons passing from the enclosure through said orifice, the free electrons colliding with the atoms producing a plasma of positively charged ions, said layer of insulating material having a potential approximately equal to that of the plasma, thereby protecting the metallic electron emitter from sputtering erosion and thermally insulating said electron emitter so that it operates with less heat loss and at a lower voltage, improving its efficiency.

9. The free electron source of claim 8, wherein the enclosure includes a plurality of orifices disposed proximate the end of the metallic electron emitter, the orifices being oriented generally in a radial direction about a central longitudinal axis of the metallic electron emitter to direct positively charged ions away from a negatively charged surface lying on said axis.

10. The free electron source of claim 8, wherein the means for initiating heating of the metallic electron emitter comprise a tickler electrode disposed in close proximity to said electron emitter, the tickler electrode having an applied electric potential that is much more positive than the potential of said electron emitter, causing free electrons to be emitted from said electron emitter and electrostatically accelerated toward the tickler electrode, a portion of the ions formed by collision of said free electrons with the atoms of gas being electrostatically attracted to a portion of the surface of said metallic electron emitter that is not coated with the layer of insulating material and heating said electron emitter as they collide with it.

11. The free electron source of claim 10, further comprising means for de-energizing the tickler electrode once the metallic electron emitter is sufficiently hot to thermally emit free electrons, after first energizing an anode disposed in an adjacent connected chamber with an electric potential substantially more positive than said electron emitter, so that the anode attracts the free electrons in place of the tickler electrode.

12. The free electron source of claim 10, wherein said electron emitter is tubular, having an open center and wherein the tickler electrode is disposed inside the center of the metallic electron emitter.

13. The free electron source of claim 10, wherein the tickler electrode comprises an annular ring disposed proximate the end of the metallic electron emitter.

14. The free electron source of claim 8, wherein the insulating material is selected from the group consisting of metallic oxides, metallic nitrides and ceramics, and has a dielectric strength in excess of 100 volts/mil.

15. In an ion accelerator having a source of free electrons and means for conveying a gaseous flow of neutral atoms into a chamber where the free electrons are accelerated toward an anode by an electrostatic potential, colliding with the neutral atoms to produce a plasma of positively charged ions, a magnetic confinement deflector for increasing the distance that the free electrons would otherwise travel prior to their impact on the anode and for magnetically containing the plasma, said magnetic confinement deflector comprising a plurality of first bar magnets disposed in a spaced apart circular array defining a picket fence around the source of free electrons, a pole face of each of the first bar magnets being tangentially aligned with a first section of the chamber, with one edge of each first bar magnet being disposed proximate the source and an opposite edge distal from the source, a distance between opposite pole faces of each of said first bar magnets being substantially greater than the space between adjacent first bar magnets.

16. The magnetic deflector of claim 15, wherein planar surfaces of the first bar magnets are radially aligned about said source, the first section diverging away from said source; and wherein the pole faces of adjacent first bar magnets that are tangentially aligned with the first section alternate in polarity, the magnetic field between said pole faces of adjacent first bar magnets acting to deflect the free electrons into a helical path as the free electrons are accelerated toward the anode, the helical path being much longer than a straight line between said source of free electrons and the anode, so that the probability of a collision between an electron and the atoms of gas flowing into the chamber is increased.

17. The magnetic confinement deflector of claim 15, further comprising a plurality of second bar magnets disposed in a spaced apart circular array defining a picket fence about an accelerator grid, a pole face of each of the second bar magnets being tangentially aligned with a second section of the chamber, edges of the second bar magnets distal from the accelerator grid being disposed proximate the edges of the first bar magnets that are distal from the source.

18. The magnetic confinement deflector of claim 17, wherein planar sufaces of the second bar magnets are aligned with the planar surfaces of the first bar magnets, and wherein the pole faces of adjacent second bar magnets that are tangentially aligned with the second section alternate in polarity, the magnetic field between said pole faces of adjacent second bar magnets acting to deflect the free electrons into a helical path as the free electrons are accelerated toward the anode, the helical path being much longer than a straight line between said source of free electrons and the anode, so that the probability of a collision between an electron and the atoms of gas flowing into the chamber is increased.

19. The magnetic confinement deflector of claim 17 further comprising a plurality of pole pieces disposed inside the chamber, each being aligned with the pole face of one of the first and second bar magnets, said pole pieces acting to concentrate the magnetic field inside the chamber, the first and second bar magnets being disposed outside the chamber and thus protected from heat produced by the plasma.

20. The magnetic confinement deflector of claim 19 wherein the pole pieces are coated with a layer of an insulating material having a much higher dielectric constant than the pole pieces, said insulating material protecting the pole pieces from collisions with free electrons and ions.

21. The magnetic confinement deflector of claim 20, wherein the insulating material is selected from the group consisting of metallic oxides, metallic nitrides, and ceramics, and has a dielectric strength in excess of 100 volts/mil.

22. The magnetic confinement deflector of claim 17, wherein a maximum spacing between adjacent second bar magnets is substantially less than a radial distance between the pole faces of each of said magnets.

23. In an ion accelerator having a source of free electrons and means for conveying a gaseous flow of neutral atoms into a chamber where the free electrons are accelerated toward an anode by an electrostatic potential, colliding with the neutral atoms to produce a plasma of positively charged ions, a magnetic confinement deflector for increasing the distance that the free electrons would otherwise travel prior to their impact on the anode and for magnetically containing the plasma, said magnetic confinement deflector comprising a plurality of first bar magnets disposed in a spaced apart circular array defining a picket fence around the source of free electrons, a pole face of each of the first bar magnets being tangentially aligned with a first section of the chamber, with one edge of each first bar magnet being disposed proximate the source and an opposite edge distal from the source, said first bar magnets diverging away from said source of free electrons so that the edges of said first bar magnets that are proximate the source are closer to each other than the edges of said first bar magnets that are distal from the source.

24. The magnetic detector of claim 23, further comprising a plurality of second bar magnets disposed in a spaced apart circular array defining a picket fence about an accelerator grid, a pole face of each of the second bar magnets being tangentially aligned with a second section of the chamber, edges of the second bar magnets distal from the accelerator grid being disposed proximate the edges of the first bar magnets that are distal from the source.

25. The magnetic deflector of claim 24, wherein planar surfaces of the second bar magnets are aligned with the planar surfaces of the first bar magnets, and wherein the pole faces of adjacent second bar magnets that are tangentially aligned with the second section alternate in polarity, the magnetic field between said pole faces of adjacent first bar magnets and adjacent second bar magnets acting to deflect the free electrons into a helical path as the free electrons are accelerated toward the anode, the helical path being much longer than a straight line between said source of free electrons and the anode, so that the probability of a collision between an electron and the atoms of gas flowing into the chamber is increased.

26. The magnetic deflector of claim 24, further comprising a plurality of pole pieces disposed inside the chamber, each being aligned with the pole face of one of the first and second bar magnets, said pole pieces acting to concentrate the magnetic field inside the chamber, the first and second bar magnets being disposed outside the chamber and thus protected from heat produced by the plasma.

27. The magnetic deflector of claim 26, wherein the pole pieces are coated with a layer of an insulating material having a much higher dielectric constant than the pole pieces, said insulating material protecting the pole pieces from collisions with free electrons and ions.

28. The magnetic deflector of claim 27, wherein the insulating material is selected from the group consisting of metallic oxides, metallic nitrides, and ceramics, and has a dielectric strength in excess of 100 volts/mil.

29. The magnetic deflector of claim 24, wherein a maximum spacing between adjacent first bar magnets and between adjacent second bar magnets is substantially less than a radial distance between the pole faces of each of said magnets.

* * * * *